United States Patent [19]

Rawstron et al.

[11] Patent Number: 4,930,938

[45] Date of Patent: Jun. 5, 1990

[54] OFFSHORE PLATFORM DECK/JACKET MATING SYSTEM AND METHOD

[75] Inventors: Philip J. M. Rawstron; Francis D'Abrera, both of Surrey, England

[73] Assignee: Exxon Production Research Company, Houston, Tex.

[21] Appl. No.: 360,827

[22] Filed: Jun. 2, 1989

[51] Int. Cl.[5] ..... E02B 17/04

[52] U.S. Cl. ..... 405/204; 405/209; 405/206; 405/203

[58] Field of Search ..... 405/204, 203, 209, 205, 405/206; 114/265

[56] References Cited

U.S. PATENT DOCUMENTS

| | | | |
|---|---|---|---|
| 3,485,051 | 12/1969 | Watkins | 405/204 |
| 4,222,683 | 9/1980 | Schaloske et al. | 405/204 |
| 4,242,011 | 12/1980 | Karsan et al. | 405/204 |
| 4,252,468 | 2/1981 | Blight | 405/204 |
| 4,252,469 | 2/1981 | Blight et al. | 405/204 |
| 4,413,926 | 11/1983 | Ninet | 405/204 |
| 4,436,454 | 3/1984 | Ninet et al. | 405/204 |
| 4,607,982 | 8/1986 | Brasted et al. | 405/204 |
| 4,655,641 | 4/1987 | Weyler | 405/204 |
| 4,662,788 | 5/1987 | Kypke et al. | 405/204 |
| 4,714,382 | 12/1987 | Khachaturian | 405/204 |
| 4,729,695 | 3/1988 | Silvestri | 405/204 |
| 4,761,097 | 8/1988 | Turner | 405/204 |
| 4,848,967 | 7/1989 | Weyler | 405/204 |
| 4,854,779 | 8/1989 | Luyties | 405/205 |

OTHER PUBLICATIONS

Ramzan, F. A., "Installation Techniques for Integrated Decks", The Society of Naval Architects and Marine Engineers, New York, New York, presented at the International Maritime Innovation Symposium, Waldorf Astoria Hotel, New York, Sep. 27–28, 1984.

White, G. J., "Offshore Installation of an Integrated Deck onto a Preinstalled Jacket", Offshore Technology Conference No. 5260, presented at the 18th Annual Offshore Technology Conference, Houston, Tex., May 5–6, 1986.

*Primary Examiner*—Dennis L. Taylor
*Assistant Examiner*—J. Russell McBee
*Attorney, Agent, or Firm*—Keith A. Bell

[57] ABSTRACT

A system and method for mating a preconstructed integrated deck mounted on a barge with a previously installed offshore jacket is provided. The system comprises at least two primary load transfer units, at least one secondary load transfer unit, and a plurality of drop block assemblies. The primary load transfer units are designed to absorb a portion of the weight of the integrated deck as the integrated deck is lowered onto the jacket. The secondary load transfer units are designed to engage after a portion of the weight of the integrated deck has been absorbed by the primary load transfer units and to assist the primary load transfer units in absorbing an additional portion of the weight of the integrated deck as it continues to be lowered onto the jacket. The drop block assemblies are designed to disengage the integrated deck from the barge and thereby transfer the remaining weight of the integrated deck to the jacket.

29 Claims, 5 Drawing Sheets

OFFSHORE PLATFORM DECK/JACKET MATING SYSTEM AND METHOD

FIELD OF THE INVENTION

The present invention relates to construction of offshore platforms. More particularly, but not by way of limitation, the present invention relates to a system and method for aligning and mating an integrated deck transported by a barge with a previously installed offshore platform jacket.

BACKGROUND OF THE INVENTION

In offshore petroleum operations, platforms comprising a trussed steel framework, known as a "jacket", secured to the seafloor and a deck mounted on top of the jacket are commonly used to drill for and produce oil and gas. Typically, the deck is mated to the jacket after the jacket has been installed by lifting individual components of the deck, known as "modules", including deck sections, crew facilities, and drilling and production equipment, onto the jacket with a barge-mounted crane. After the individual modules are lifted onto the jacket, they are interconnected and commissioned.

This approach generally works quite well, however, costs can be very high due to the extensive offshore construction required. Offshore construction is very expensive for a number of reasons, including down-time caused by rough weather and the need for special offshore construction vessels. In the case of very large platforms, or platforms located in remote areas, offshore construction may require many months and millions of man-hours to complete.

An alternate approach to mating platform decks and jackets, known as the "integrated deck approach", has been introduced in recent years. With the integrated deck approach, a one-piece deck is used, with most or all components being integrated at an onshore construction yard. By using the integrated deck approach, offshore construction time is greatly reduced. This not only substantially reduces offshore construction costs, but it also makes this approach attractive for offshore areas having short construction seasons due to rough seas or the presence of sea ice.

Because an integrated deck consists of a single unit comprising most or all of the modules used for drilling and Production, it can be very heavy. Integrated decks having total weights of 40,000 tons or more have been proposed. For this reason, integrated decks are not lifted onto platform jackets with barge-mounted cranes. Instead, the integrated deck is carried to the jacket on a barge, and the barge is then ballasted to lower the integrated deck onto the jacket. Typically, the jacket will have a slot into which the barge is maneuvered. The integrated deck extends over both sides of the barge and mates with the jacket as the barge is ballasted.

Because the integrated deck is carried by a barge during the mating operation, it is subject to movement caused by the action of wind on the barge and deck, and more importantly, by the action of waves and currents on the barge. This movement can make proper alignment of the integrated deck with the jacket very difficult. Moreover, large sudden movements of the integrated deck resulting from motions of the barge can cause the deck legs to slam into the jacket, thereby damaging the legs and/or the jacket.

Although various apparatus for aligning and mating integrated decks with jackets have been used and proposed, these apparatus are generally not satisfactory for use in moderate sea states or are too complicated and expensive to be practical. The integrated deck approach is therefore currently limited to areas where higher seas are not likely during the mating operation, and as a result, the advantages to using this approach currently cannot be realized to the extent desired by the petroleum industry. For this reason, there is a need for a practical system and method which permits the alignment and mating of an integrated deck with a jacket in higher seas. The present invention is aimed at providing such a system and method.

SUMMARY OF THE INVENTION

The present invention is a system and method for mating a preconstructed integrated deck transported by a barge with a previously installed offshore platform jacket. The integrated deck and the jacket have a plurality of deck/jacket leg pairs, each of which comprises a downwardly extending leg attached to the integrated deck and a corresponding upwardly extending leg attached to the jacket.

The mating system comprises a means for lowering the integrated deck onto the jacket, a primary load transfer unit installed in at least two of the deck/jacket leg pairs, a secondary load transfer unit installed in at least a third one of the deck/jacket leg pairs, and a means adapted to disengage the integrated deck from the barge.

The primary load transfer unit consists of an alignment portion installed in one leg of the deck/jacket leg pair and a receptacle portion installed in the other leg of the deck/jacket leg pair. The alignment portion has an extendable probe attached thereto by a primary compression spring means. The receptacle portion has a stabbing cone adapted to receive the alignment probe as the deck is lowered onto the jacket.

The secondary load transfer unit consists of an engagement portion installed in one of the legs of the deck/jacket leg pairs and a receptacle portion installed in the other leg of the deck/jacket leg pairs. The engagement portion has a bearing shoe attached thereto by a secondary compression spring means. The receptacle portion is adapted to receive the bearing shoe as the deck is lowered onto the jacket. The secondary load transfer unit is adapted to engage after the primary load transfer unit has engaged and the primary compression spring means has been compressed a distance so as to transfer a portion of the weight of the integrated deck to the jacket.

Prior to the mating operation, the barge is positioned so that the deck/jacket leg pairs are in approximate vertical alignment. The alignment probes of at least two of the primary load transfer units are then extended to engage the corresponding receptacle portions and thereby align the integrated deck and jacket. The integrated deck is then lowered so as to compress the primary compression spring means of the primary load transfer units, thereby transferring a first portion of the weight of the integrated deck from the barge to the jacket. After the first portion of the weight of the integrated deck has been transferred to the jacket, the secondary load transfer units engage. The integrated deck continues to be lowered so as to compress both the primary compression spring means and the secondary compression spring means, thereby transferring a second Portion of the weight of the integrated deck from the barge to the jacket. After the deck/jacket leg pairs come into physical contact, the barge is disengaged and returned to shore.

BRIEF DESCRIPTION OF THE DRAWINGS

The advantages of the present invention will be better understood by referring to the following detailed description and the attached drawings in which.

While the invention will be described in connection with its preferred embodiment, it will be understood that the invention is not limited thereto. On the contrary, it is intended to cover all alternatives, modifications, and equivalents which may be included within the spirit and scope of the invention, as defined in the appended claims.

DETAILED DESCRIPTION OF THE PREFERRED EMBODIMENTS

Figure 1:
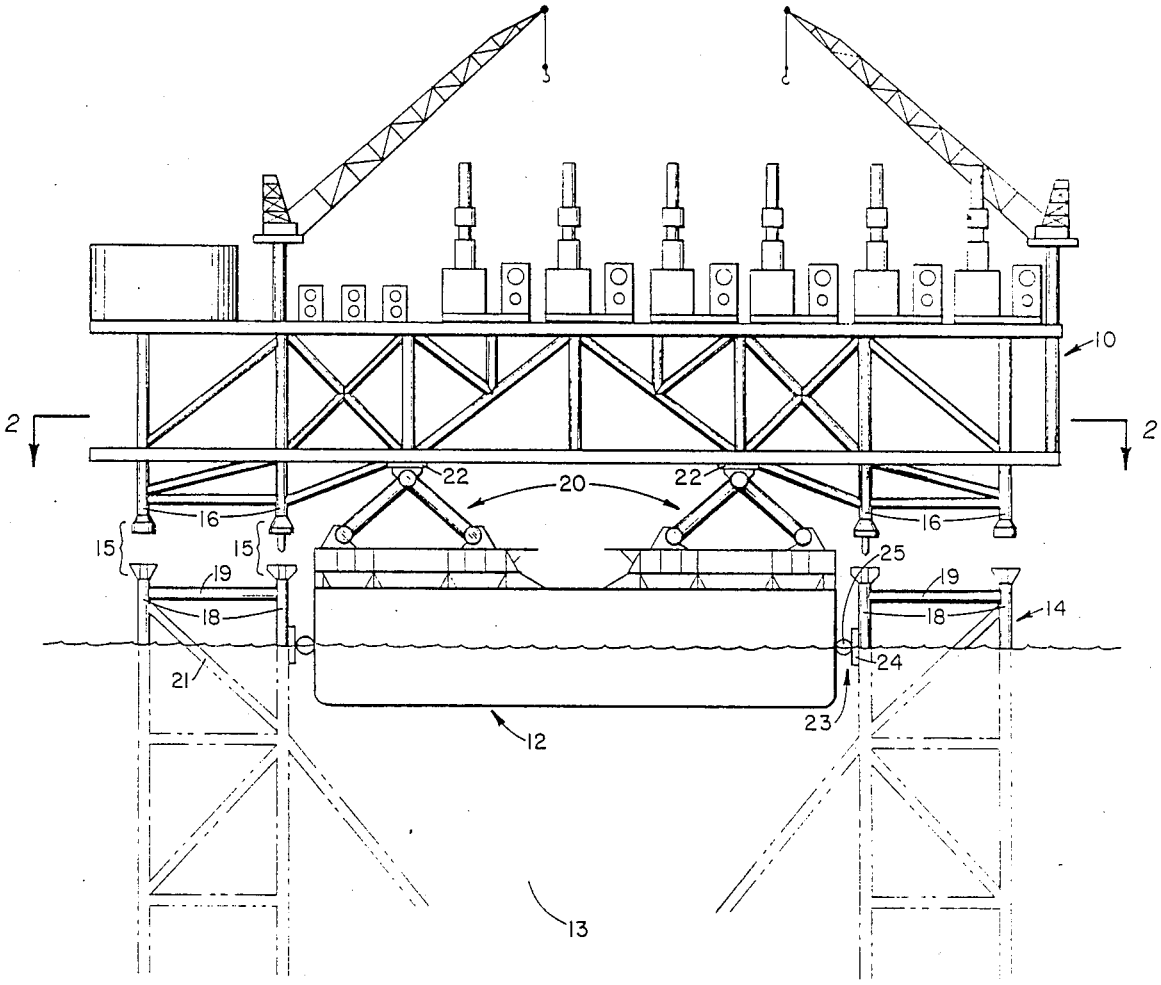
FIG. 1 is an elevational view illustrating the offshore platform deck/jacket mating system of the present invention.

Referring now to the drawings in more detail, FIG. 1 illustrates an offshore platform deck/jacket mating system in accordance with the present invention. More particularly, FIG. 1 shows an integrated deck 10 mounted on a barge 12 and positioned for mating with a previously installed offshore platform jacket 14.

The integrated deck 10 is preferably a prefabricated unit constructed onshore to be transported by the barge 12 and mated at an offshore location with the jacket 14, which is secured to the seafloor (not shown). The jacket 14 may be fixed or floating, and its general construction may be any one of a number of well known fixed or floating arrangements. The integrated deck 10 includes equipment and facilities necessary for offshore hydrocarbon drilling and producing operations.

As shown in FIG. 1, the jacket 14 is a trussed steel framework consisting of a plurality of upwardly extending jacket legs 18 interconnected by a plurality of horizontal struts 19 and angular struts 21. The jacket 14 is provided with a slot 13 which is capable of receiving the barge 12 and with a plurality of fender assemblies 23 for use in positioning the barge 12 within the jacket slot 13. Each fender assembly 23 comprises a truss 24 mounted on a jacket leg 18 and a bumper 25 mounted on and lowered from the barge 12. The bumper 25 can be inflatable or of other construction as necessary to properly position the barge 12 within jacket slot 13.

The integrated deck 10 has a plurality of downwardly extending deck legs 16 arranged to correspond with the upwardly extending jacket legs 18, forming a plurality of deck/jacket leg pairs 15. The integrated deck 10 is initially mounted on the barge 12 for transportation to the jacket 14. The barge 12 may be any suitable vehicle known to those skilled in the art for transporting the integrated deck 10 to such an offshore location. As illustrated in FIG. 1, the barge 12 is provided with a plurality of drop block assemblies 20 on which the integrated deck 10 is carried. The integrated deck 10 is provided with a plurality of load bearing pads 22 which rest on the drop block assemblies 20. Once the barge 12 is Properly positioned within the jacket slot 13 so that the integrated deck 10 and the jacket 14 are in approximate vertical alignment, the mating system of the present invention is utilized, as described in detail below, to transfer the weight of the integrated deck 10 from the barge 12 to the jacket 14, and the barge 12 is then returned to shore.

Figure 2:
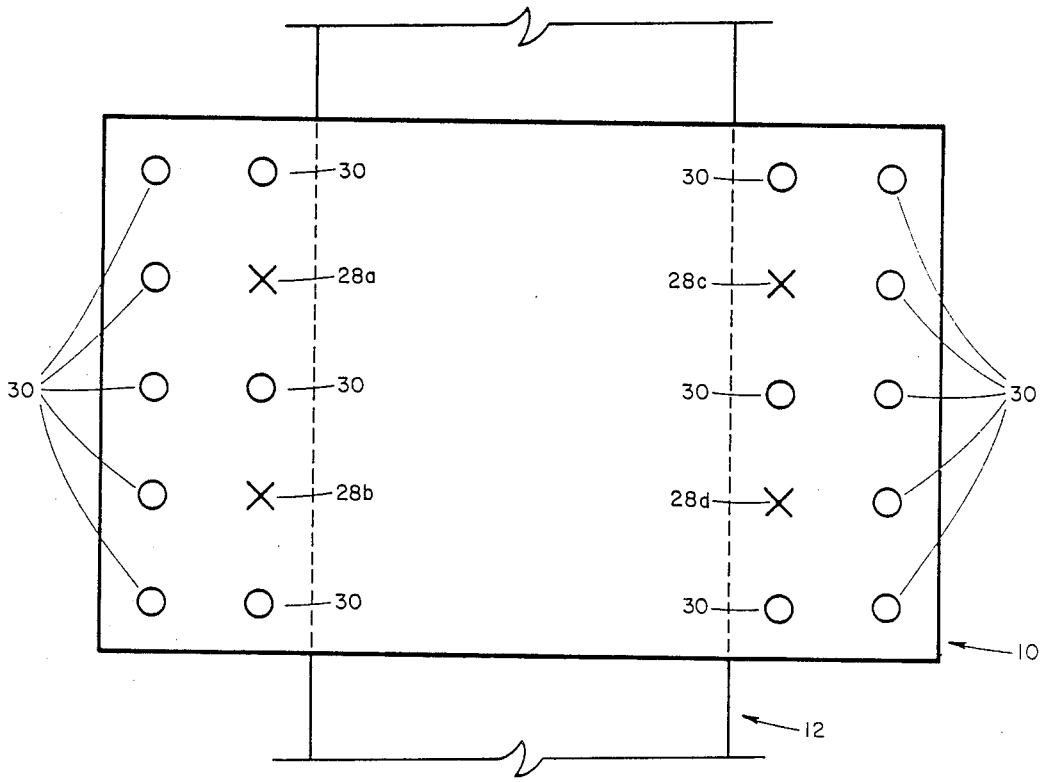
FIG. 2 is a schematic plan view illustrating the arrangement of the primary and secondary load transfer units in one embodiment of the present invention.

The mating system of the present invention comprises a primary load transfer unit 28 (FIGS. 3A, 3B, and 3C) installed in at least two of the deck/jacket leg pairs 15, a secondary load transfer unit 30 (FIG. 4) installed in at least a third one of the deck/jacket leg pairs 15, and a plurality of drop block assemblies 20. FIG. 2 schematically illustrates an embodiment of the invention in which the integrated deck 10 and the jacket 14 have a total of twenty deck/jacket leg pairs 15 arranged in two rows of five on each side of jacket slot 13. In this embodiment, four primary load transfer units 28 (28*a*, 28*b*, 28*c* and 28*d*) are installed in four interior deck/jacket leg pairs 15 and secondary load transfer units 30 are installed in the remaining sixteen deck/jacket leg pairs 15. Operation of the mating system will be described with reference to this embodiment, however other suitable arrangements will be apparent to those skilled in the art.

Figure 3C:
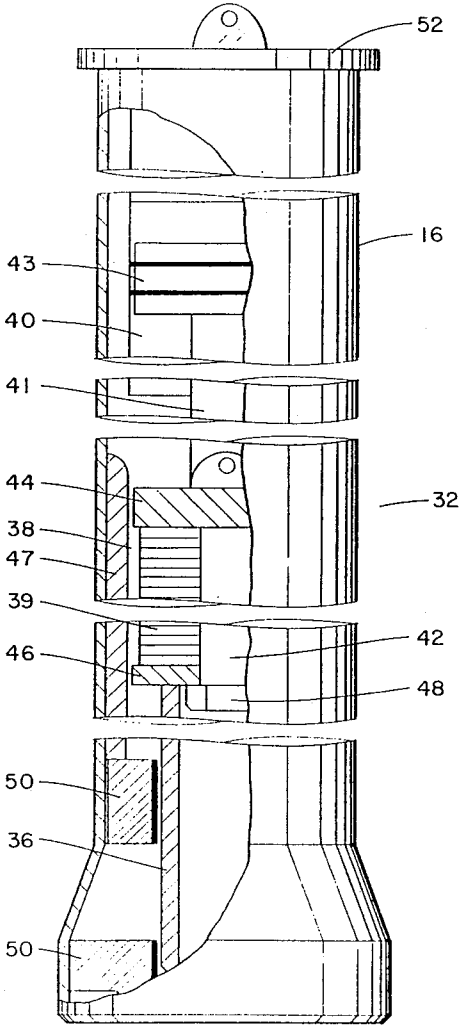
FIGS. 3A, 3B and 3C are elevational views, in partial section, of the primary load transfer unit of the present invention.
Figure 3B:
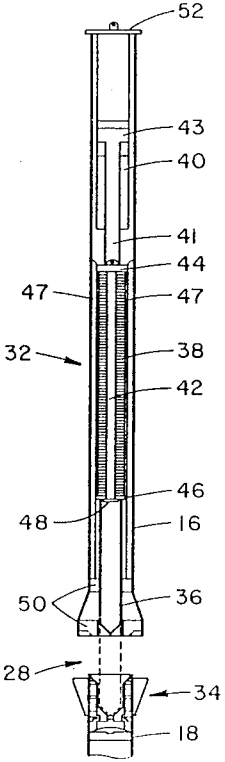
Figure 3A:
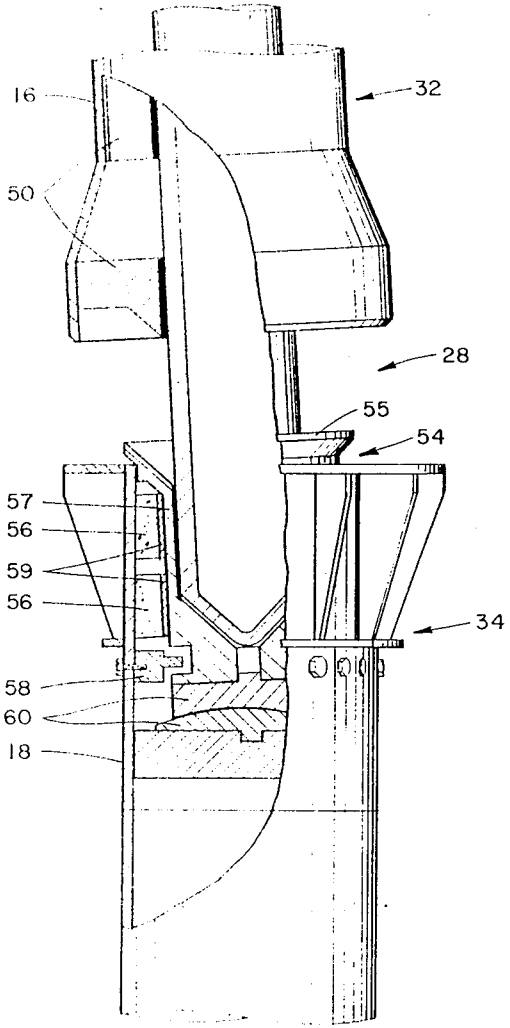

FIGS. 3A, 3B, and 3C illustrate the primary load transfer unit 28 comprising an alignment portion 32 and a receptacle portion 34. As illustrated, the alignment portion 32 is installed in the deck leg 16, and the receptacle portion 34 is installed in the corresponding jacket leg 18. However, those skilled in the art will recognize that the primary load transfer unit 28 could readily be inverted with the alignment portion 32 in the jacket leg 18 and the receptacle portion 34 in the deck leg 16.

Referring now to FIGS. 3B and 3C, the alignment portion 32 of the primary load transfer unit 28 consists of an extendible alignment probe 36, a primary compression spring means 38, a hydraulic cylinder 40, and various ancillary parts. Preferably, the primary compression spring means 38 consists of a stack of elastomeric elements 39 held in column by guide rod 42. In a preferred embodiment, the elastomeric elements 39 are made of polyurethane or a similar resilient material and are bonded to steel disks. The properties of such resilient material include an increase in stiffness with compression and a high degree of hysteresis or damping, which results in a shock absorbing effect. Guide rod 42 is attached at its upper end to guided top plate 44 which in turn is attached to the piston rod 41 of hydraulic cylinder 40. Guided bottom plate 46 is axially slidable and is retained on guide rod 42 by rod retainer 48. Alignment probe 36 has a conical lower end and a generally cylindrical body having an inner diameter which is somewhat larger than the outer diameter of rod retainer 48. The upper end of alignment probe 36 is attached to guided bottom plate 46 so as to encompass rod retainer 48. Accordingly, an upward axial load on alignment probe 36 will cause the primary compression spring means 38 to compress as guided bottom plate 46 slides upwardly on guide rod 42 and guide rod 42 telescopes into alignment probe 36. A pair of lateral bearing rings 50 are used to absorb lateral loads and induced moments on alignment probe 36 and to provide a smooth sliding surface for alignment probe 36.

Prior to the mating operation, the alignment probe 36 is in its retracted position within deck leg 16, as illustrated in FIG. 3B. During the mating operation, the alignment probe 36 is extended by hydraulic cylinder 40. A plurality of longitudinal guide rails 47 are attached to the inner surface of the deck leg 16. Guided top plate 44 and guided bottom plate 46 slide downwardly along guide rails 47, and alignment probe 36 slides downwardly along lateral bearing rings 50. When alignment probe 36 has been fully extended, piston 43 is hydraulically locked in place. The integrated deck 10 is then lowered by ballasting the barge 12 until the alignment probe 36 is seated within the receptacle portion 34. Further lowering of the integrated deck 10 will place an upward axial load on the alignment probe 36 causing the primary compression spring means 38 to compress, thereby transferring a portion of the weight of the integrated deck 10 from the barge 12 to the jacket 14. Continued lowering will cause an increasing portion of the weight of the integrated deck 10 to be transferred to the jacket 14. Optionally, the alignment portion 32 of the primary load transfer unit 28 may include a flange cap 52 which permits the various internal components of both the alignment portion 32 and the receptacle portion 34 to be removed for subsequent reuse after the mating operation is complete.

Referring now to FIG. 3A, the receptacle portion 34 of the primary load transfer unit 28 consists of a stabbing cone 54 adapted to receive the alignment probe 36 as the integrated deck 10 is lowered onto the jacket 14, lateral bearing elastomers 56, a shear ring 58, and a spherical bearing 60. The stabbing cone 54 provides both alignment guidance and lateral stiffness to restrain lateral deflections of the alignment probe 36. In a preferred embodiment, the stabbing cone 54 consists of an initial target cone 55 and a cylindrical sleeve 57. The length of the cylindrical sleeve 57 is determined such that once the alignment probe 36 is fully engaged it will not disengage during the maximum anticipated heave of the barge 12. As more fully described below, this feature ensures proper final alignment between the integrated deck 10 and the jacket 14.

The stabbing cone 54, including the target cone 55 and cylindrical sleeve 57, is mounted on a large diameter spherical bearing 60 which allows the stabbing cone 54 to rotate sideways (as illustrated in FIG. 3A) as if pivoted about a point substantially below the top of the jacket leg 18. This allows the radial bearing elastomers 56 to act as lateral stiffness elements, thereby reducing the lateral loads on the deck leg 16, the jacket leg 18, and the alignment probe 36. The shear ring 58 restrains the stabbing cone 54 from lifting out of the receptacle portion 34.

The lateral bearing elastomers 56 are preferably made of polyurethane and are bonded to steel rings 59 mounted on the outside of cylindrical sleeve 57. The number, thickness, and material composition of the lateral bearing elastomers 56 are adjusted to achieve the desired lateral stiffness.

Figure 4:
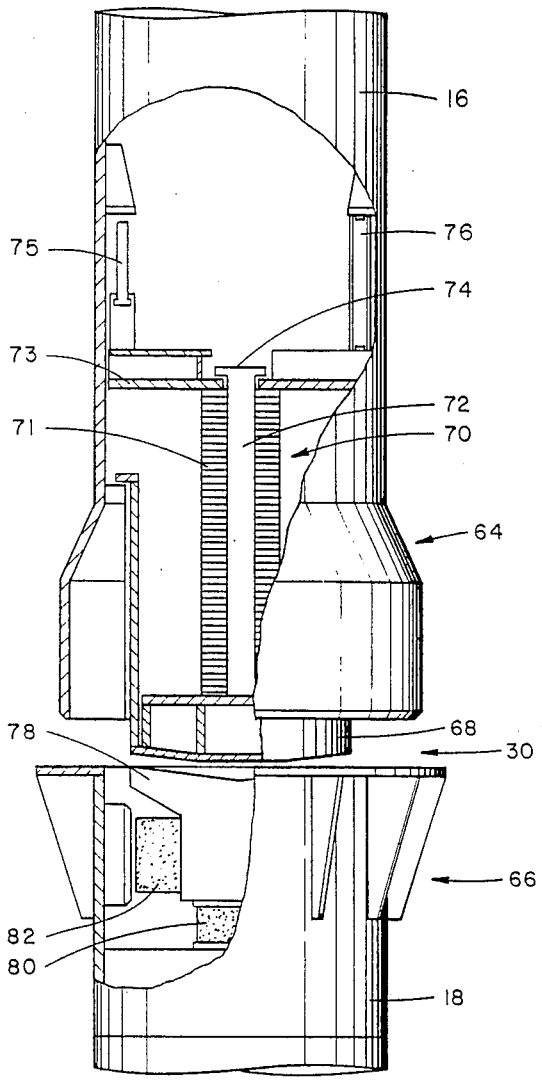
FIG. 4 is an elevational view, in partial section, of the secondary load transfer unit of the present invention.

FIG. 4 illustrates the secondary load transfer unit 30 comprising an engagement portion 64 and a receptacle portion 66. As illustrated in FIG. 4, the engagement portion 64 is installed in the deck leg 16 and the receptacle portion 66 is installed in the corresponding jacket leg 18. However, those skilled in the art will recognize that the secondary load transfer unit 30 could readily be inverted with the engagement portion 64 in the jacket leg 18 and the receptacle portion 66 in the deck leg 16.

Preferably, the engagement portion 64 and the receptacle portion 66 of the secondary load transfer unit 30 will engage after a portion of the weight of the integrated deck 10 has been transferred to the jacket 14 by the primary load transfer units 28. At this point, proper alignment of the integrated deck 10 and jacket 14 is ensured. Secondary load transfer units 30 provide only minimal alignment assistance during the final stages of the mating operation.

The engagement portion 64 of the secondary load transfer unit 30 has a bearing shoe 68, a secondary compression spring means 70, a centralizing rod 72 having a retaining cap 74 at one end and attached to the bearing shoe 68 at the other end, a reaction plate 73, and a plurality of load bearing struts 76. In a preferred embodiment, the secondary compression spring means 70 comprises a stack of elastomeric elements 71 held in column by centralizing rod 72. As with the primary compression spring means 38, these elastomeric elements 71 are preferably made from polyurethane or a similar resilient material. After the bearing shoe 68 has contacted the receptacle portion 66, further lowering of the integrated deck 10 will cause the secondary compression spring means 70 to be compressed between the bearing shoe 68 and the reaction plate 73. This load is transferred from the reaction plate 73 to the deck leg 16 by the load bearing struts 76. Optionally, the assembly may include a plurality of load decompressing jacks 75 which can be used to release the load in secondary compression spring means 70 after the mating operation is complete. This will permit the various internal components of the engagement portion 64 and the receptacle portion 66 to be recovered for subsequent reuse. A flange cap (not shown) similar to flange cap 52 used in connection with the primary load transfer units 28 (See FIGS. 3B and 3C) could be used to provide access to the interior of deck leg 16.

The receptacle portion 66 of the secondary load transfer unit 30 is adapted to receive the bearing shoe 68 as the integrated deck 10 is lowered onto the jacket 14. The receptacle portion 66 comprises a landing cone 78 which is a slightly conically dished anvil like structure, preferably made of steel, mounted on an elastomeric shear and compression bearing 80, preferably made of polyurethane or a similar material, and which provides a slight vertical deflection sufficient to ensure that the shoulder of the bearing shoe 68 will penetrate slightly below the top of the jacket leg 18. Radial bearing elastomers 82, preferably made of polyurethane or a similar material, are used to provide lateral resilience and should be designed to provide approximately equivalent lateral stiffness to that of the primary load transfer units 28. However, the anticipated total vertical deflection of both secondary compression spring means 70 and elastomeric shear and compression bearing 80 should not be more than approximately one-third of that required for the primary load transfer units 28.

Figure 5B:
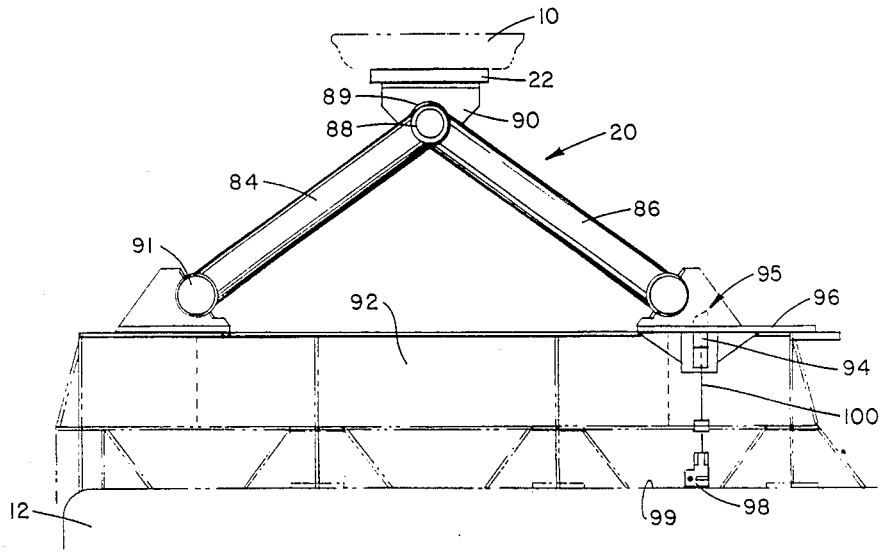
FIGS. 5A and 5B are, respectively, perspective and side elevational views of the drop block assembly of the present invention.
Figure 5A:
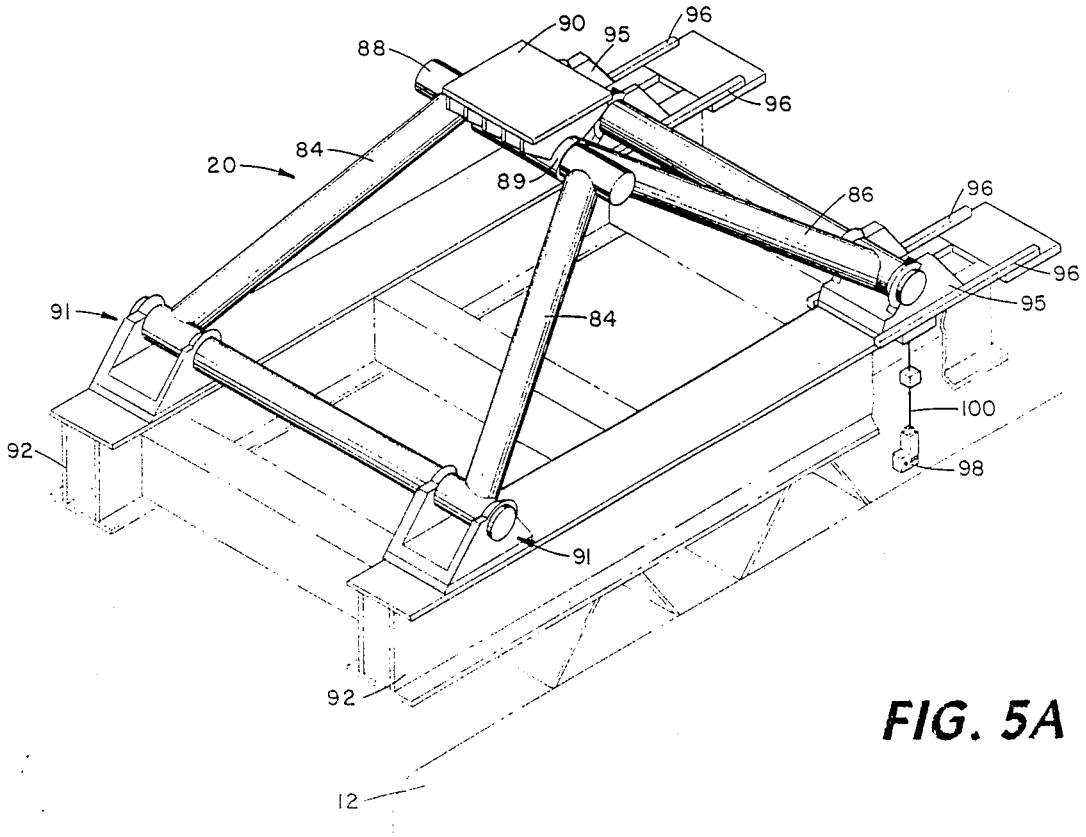

FIGS. 5A and 5B illustrate a drop block assembly 20 which is adapted to rapidly disengage the integrated deck 10 from the barge 12. Drop block assembly 20 comprises two outboard braces 84 and two inboard braces 86 connected in pairs to two concentric tubular members 88 and 89, respectively, which comprise the apex of the A-frames formed by the outboard braces 84 and the inboard braces 86. Tubular member 88 has an outer diameter which is somewhat smaller than the inner diameter of tubular member 89. The two outboard braces 84 connect on the end lengths of the longer tubular member 88, and the two inboard braces 86 connect on the shorter tubular member 89. Tubular member 89 also carries the support pad 90, which forms one of the support points for the load bearing pads 22 of the integrated deck 10.

The outboard braces 84 are pivotally attached at their lower ends to bearings 91 which are fixedly attached to barge 12 by transverse box girder 92. The inboard braces 86 are pivotally attached at their lower ends to sliding bearings 95 which are adapted to slide inwardly towards the centerline of barge 12 along guide rails 96. This will allow the drop block assembly 20 to rapidly disengage the integrated deck 10 from the barge 12 and collapse flat. Those skilled in the art will recognize that the outboard braces 84 could be attached to sliding bearings adapted to slide outwardly towards the outer edge of the barge 12 while the inboard braces 86 could be attached to bearings fixedly attached to the barge 12. The sliding bearings 95 are latched in place by latches 94. Latch 94 can be released from below by being drawn downward by threaded reach rod 100 which is driven by geared electric motor and worm gear shaft 98 mounted on the barge deck 99. Other means for latching and unlatching sliding bearings 95 will be apparent to those skilled in the art.

Operation of the offshore platform deck/jacket mating system of the present invention will be described with respect to the embodiment illustrated in FIG. 2. The integrated deck 10 is mounted on the barge 12 and transported to the previously installed offshore platform jacket 14. The barge 12 is then positioned within the jacket slot 13 so that the deck/jacket leg pairs 15 are in approximate vertical alignment. The integrated deck 10 is positioned over the jacket 14 so that a sufficient air gap exists between the deck legs 16 and the jacket legs 18 to prevent the deck 10 from slamming into the jacket 14 when the barge 12 is at its maximum heave cycle.

As noted above, four of the twenty deck/jacket leg pairs 15 are equipped with primary load transfer units 28 (28*a*, 28*b*, 28*c*, and 28*d* in FIG. 2) and the remaining sixteen deck/jacket leg pairs 15 are equipped with secondary load transfer units 30. The alignment probes 36 installed in two of the diagonally opposed primary load transfer units (e.g., units 28*a* and 28*d*) will be hydraulically lowered into the corresponding receptacle portions 34, thereby ensuring proper alignment of the deck 10 with the jacket 14. The alignment probes 36 on the two remaining primary load transfer units (28*b* and 28*c*) will then be hydraulically lowered into the corresponding receptacle portions 34. The alignment probes 36 will be of sufficient length to engage the receptacle portions 34 before the integrated deck 10 has been lowered.

The integrated deck 10 is then lowered by ballasting the barge 12. Consequently, the primary compression spring means 38 in the primary load transfer units 28 are compressed and a portion of the weight of the integrated deck 10 is thereby transferred from the barge 12 to the jacket 14. After a portion of the weight of the integrated deck 10 has been transferred to the jacket 14, the secondary load transfer units 30 installed in the remaining sixteen deck/jacket leg pairs 15 come into contact as the bearing shoes 68 engage the corresponding landing cones 78.

Lowering of the barge 12 continues and the secondary load transfer units 30 assist the primary load transfer units 28 in absorbing an additional portion of the weight of the integrated deck 10. In a preferred embodiment, the spring rate of the secondary compression spring means 70 is adapted to provide appropriate dynamic response for the overall deck mating operation. Preferably, the spring rate of the secondary compression spring means 70 is less than that of the primary compression spring means 38. The secondary load transfer units 30 share the load with the primary load transfer units 28 until metal to metal contact occurs between the deck legs 16 and the corresponding jacket legs 18.

Once structural contact is achieved, the integrated deck 10 will cease to move significantly, however dynamic loads from wave action on the barge 12 are still present. Therefore, in order to avoid premature separation of the integrated deck 10 and the barge 12, once a significant portion of the weight of the integrated deck 10 has been transferred to the jacket 14, preferably more than 75%, the collapsible drop block assemblies 20 will be rapidly disengaged from the integrated deck 10, thereby transferring the remaining weight of the integrated deck 10 to the jacket 14. The barge 12 will then be released, withdrawn, and transported to shore.

EXAMPLE

A feasibility study covering the design of a deck/jacket mating system based on the present invention is described below. The integrated deck 10 on which the feasibility study was based has overall horizontal dimensions of 350 feet by 240 feet and a total weight of 75 million pounds (75,000 kips). The mating system was based on the arrangement illustrated in FIG. 2 (i.e., four primary load transfer units 28*a*, 28*b*, 28*c*, and 28*d* and sixteen secondary load transfer units 30).

With reference to FIGS. 3A, 3B, and 3C, the alignment probe 36 of each of the primary load transfer units 28 is a heavy wall steel component having a nominal outside diameter of 40 inches. The hydraulic cylinder 40 has a 60 inch bore, a working pressure of 3000 psi and a stroke of 12 feet. The primary compression spring means 38 has an overall uncompressed length of approximately 32 feet and is comprised of a stack of 82 polyurethane washers, each of which is 3.5 inches thick and has a 44 inch outside diameter and a 22 inch inside diameter. Steel plates are bonded to both sides of the polyurethane washers. The initial stiffness of the primary compression spring means 38 is approximately 915 kips/foot.

The initial target cone 55 of the stabbing cone 54 (FIG. 3A) has a 70 inch diameter. The cylindrical sleeve 57 has an internal diameter of 45 inches. The length of sleeve 57 is selected so that once alignment probe 36 is fully engaged therein, it will not disengage during a maximum heave cycle. Lateral bearing elastomers 56 are polyurethane elements bonded to steel rings mounted on the outside of sleeve 57. These polyurethane elements have 72 inch outer diameters and 50 inch inner diameters. Spherical steel bearing 60 allows the unit to deflect laterally as if pivoted about a point approximately 200 inches below the top of jacket leg 18.

Turning now to FIG. 4, the bearing shoes 68 of the secondary load transfer units 30 will engage the corresponding landing cones 78 when the gap between the deck leg 16 and the jacket leg 18 has been reduced to approximately one foot. The secondary compression spring means 70 is comprised of a stack of 46 polyurethane washers, each of which is 1.25 inches thick and has a 27 inch outside diameter and a 13 inch inside diameter. Preferably, steel plates are bonded to one side only of each polyurethane washer and the elements are stacked in alternating pairs so that the steel backing plates are together and the elastomeric surfaces are in contact with each other. The initial stiffness of the secondary compression spring means 70 is approximately 500 kips/foot.

The integrated deck 10 is transported to the installation site on a barge 12. A total of 10 drop block assemblies 20, each of which is designed to carry a vertical load of 11,150 kips are used to support the deck on the barge 12. The vertical distance between the centerline of concentric tubular members 88 and 89 and the centerline of bearings 91 and 95 is approximately 14.5 feet. Braces 84 and 86 are constructed from 36 inch outside diameter heavy wall tubing.

After the barge 12 has been positioned within the jacket slot 13, but prior to commencement of ballasting, the vertical separation between the bottom of deck legs 16 and the top of the corresponding stabbing cones 54 is approximately five feet. The stabbing cones 54 project approximately one foot above the tops of jacket legs 18. Therefore, the total set down distance for the integrated deck 10 is approximately six feet.

The first 30 percent of the weight of the integrated deck 10 will be transferred to the jacket 14 by the four primary load transfer units 28 over the first five feet of downward movement. At this point, the sixteen secondary load transfer units 30 will come into contact and will assist the primary load transfer units 28 in transferring an additional 20 percent of the weight of the integrated deck 10 to the jacket 14 during the last one foot of downward movement. Accordingly, approximately 50 per cent of the total weight of the integrated deck 10 will have been transferred to the jacket 14 by the time the deck legs 16 physically contact their corresponding jacket legs 18. Ballasting continues until approximately 80 percent of the deck weight has been transferred to the jacket 14, at which point the drop block assemblies 20 are collapsed, thereby transferring the remainder of the weight of the integrated deck 10 to the jacket 14. The barge 12 is then removed from jacket slot 13 and returned to shore.

As described and illustrated herein, the present invention satisfies the need for a practical system and method which can permit the alignment and mating of an integrated deck with a jacket in higher seas than have previously been possible. It should be understood that the invention is not to be unduly limited to the foregoing which has been set forth for illustrative purposes. Various alterations and modifications of the invention will be apparent to those skilled in the art without departing from the true scope of the invention, as defined in the following claims.

What we claim is:

1. A system for mating a preconstructed integrated deck transported by a barge with a previously installed offshore platform jacket, said integrated deck being positioned generally above said jacket, said integrated deck and said jacket having a plurality of deck/jacket leg pairs each of which consists of a downwardly extending leg attached to said integrated deck and a corresponding upwardly extending leg attached to said jacket, said mating system comprising:

(a) means for lowering said integrated deck onto said jacket;

(b) a primary load transfer unit installed in at least two of said deck/jacket leg pairs, each said primary load transfer unit comprising (1) an alignment portion installed in one of said legs of said deck/jacket leg pair, said alignment portion having an extendable alignment probe attached thereto by a primary compression spring means and (2) a receptacle portion installed in the other of said legs of said deck/jacket leg pair, said receptacle portion having a stabbing cone mounted on a large diameter spherical bearing adapted to permit said stabbing cone to move laterally across the surface of said bearing, said stabbing cone adapted to receive said extendable alignment probe portion as said deck is lowered onto said jacket;

(c) a secondary load transfer unit installed in at least a third one of said deck/jacket leg pairs, said secondary load transfer unit comprising (1) an engagement portion installed in one of said legs of said deck/jacket leg pair, said engagement portion having a bearing shoe attached thereto by a secondary compression spring means and (2) a receptacle portion installed in the other of said legs of said deck/jacket leg pair, said receptacle portion adapted to receive said bearing shoe as said deck is lowered onto said jacket, said secondary load transfer unit adapted to engage after said primary load transfer unit has engaged and said first compression spring means has been compressed a distance so as to transfer a portion of the weight of said integrated deck to said jacket; and (d) means for disengaging said integrated deck from said barge.

2. The system of claim 1 wherein said means for lowering said integrated deck onto said jacket comprises means for ballasting said barge.

3. The system of claim 1 wherein said primary compression spring means comprises a plurality of elastomeric elements held in column by a guide rod.

4. The system of claim 3 wherein said elastomeric elements are made from a resilient material characterized by an increase in stiffness with compression and a high degree of damping.

5. The system of claim 4 wherein said resilient material is polyurethane.

6. The system of claim 1 wherein said alignment portion of said primary load transfer unit further comprises a plurality of lateral bearing rings adapted to absorb lateral loads and induced moments on said alignment probe.

7. The system of claim 1 wherein said alignment portion of said primary load transfer unit further comprises a hydraulic cylinder.

8. The system of claim 1 wherein said receptacle portion of said primary load transfer unit further comprises a plurality of lateral bearing elastomers.

9. The system of claim 8 wherein said lateral bearing elastomers are made of polyurethane.

10. The system of claim 1 wherein said secondary compression spring means comprises a plurality of elastomeric elements held in column by a centralizing rod.

11. The system of claim 10 wherein said elastomeric elements are made from a resilient material characterized by an increase in stiffness with compression and a high degree of damping.

12. The system of claim 11 wherein said resilient material is polyurethane.

13. The system of claim 1 wherein said engagement portion of said secondary load transfer unit further comprises a plurality of load decompressing jacks adapted to release the load in said secondary compression spring means.

14. The system of claim 1 wherein said receptacle portion of said second load transfer unit comprises a landing cone mounted on an elastomeric shear and compression bearing.

15. The system of claim 14 wherein said landing cone is a slightly conically dished steel anvil like structure.

16. The system of claim 14 wherein said elastomeric shear and compression bearing is adapted to provide a slight vertical deflection sufficient to ensure that said bearing shoe will penetrate slightly below the top of said jacket leg.

17. The system of claim 14 wherein said elastomeric shear and compression bearing is made of polyurethane.

18. The system of claim 1 wherein said receptacle portion of said secondary load transfer unit further comprises a plurality of radial bearing elastomers adapted to provide lateral resilience.

19. The system of claim 18 wherein said radial bearing elastomers are made of polyurethane.

20. The system of claim 1 wherein said secondary load transfer unit is adapted to engage after approximately thirty percent of the weight of said integrated deck has been transferred to said jacket.

21. The system of claim 1 wherein said means for disengaging said integrated deck from said barge comprises a plurality of drop block assemblies, each of said drop block assemblies comprising a pair of A-frames linked at their apex, each of said A-frames comprising (a) two outboard braces pivotally attached at their lower ends to fixed bearings,
(b) two inboard braces pivotally attached at their lower ends to horizontally slidable bearings, and
(c) latch means for restraining said horizontally slidable bearings.

22. A method for mating an integrated deck onto a previously installed offshore platform jacket, said integrated deck and said jacket having a plurality of deck/jacket leg pairs each of which consists of a downwardly extending leg attached to said integrated deck and an upwardly extending leg attached to said jacket, said method comprising the steps of:

(a) installing a primary load transfer unit in at least two of said deck/jacket leg pairs, each of said primary load transfer units having an extendable alignment probe and a primary compression spring means in one of said legs of said deck/jacket leg pair and a corresponding receptacle portion and a spherical bearing in the other of said legs;
(b) installing a secondary load transfer unit in at least a third one of said deck/jacket leg pairs, each of said secondary load transfer units having a secondary compression spring means in one of said legs of said deck/jacket leg pair and a corresponding receptacle portion in the other of said legs, said secondary compression spring means having a spring rate less than the spring rate of said primary compression spring means;
(c) transporting said integrated deck to said jacket on a barge;
(d) positioning said barge so that said deck/jacket leg pairs are in approximate vertical alignment;
(e) extending said alignment probe of at least two of said primary load transfer units to engage said corresponding receptacle portion and permitting said receptacle portion to slide with respect to said bearing thereby aligning said integrated deck and said jacket;
(f) lowering said integrated deck so as to compress said primary compression spring means of said primary load transfer units thereby transferring a first portion of the weight of said integrated deck to said jacket;
(g) engaging said secondary load transfer unit;
(h) continuing to lower said integrated deck so as to compress both said primary compression spring means and said secondary compression spring means thereby transferring a second portion of the weight of said integrated deck to said jacket; and
(i) disengaging said integrated deck from said barge after each of said deck/jacket leg pairs have come into physical contact.

23. The method of claim 22 wherein said step (f) of lowering said integrated deck comprises ballasting said barge.

24. The method of claim 22 wherein said first portion of said weight of said integrated deck is equal to approximately thirty percent.

25. The method of claim 22 wherein said second portion of said weight of said integrated deck is equal to approximately twenty percent.

26. The method of claim 22 wherein said step (i) of disengaging said integrated deck from said barge is performed when approximately eighty percent of said weight of said integrated deck has been transferred to said jacket.

27. The method of claim 22 wherein said step (i) of disengaging said integrated deck from said barge is performed by disengaging a plurality of drop block assemblies mounted on said barge.

28. The method of claim 22 wherein said primary compression spring means comprises a stack of polyurethane washers.

29. The method of claim 22 wherein said secondary compression spring means comprises a stack of polyurethane washers.

* * * * *